US011140955B2

(12) United States Patent
Hu

(10) Patent No.: US 11,140,955 B2
(45) Date of Patent: Oct. 12, 2021

(54) LOCKING MECHANISM FOR FOLDABLE POLE AND FOLDABLE POLE

(71) Applicant: NINGHAI XINGDA LEISURE PRODUCTS CO., LTD., Zhejiang (CN)

(72) Inventor: Jinxue Hu, Zhejiang (CN)

(73) Assignee: NINGHAI XINGDA LEISURE PRODUCTS CO., LTD., Zhejiang (CN)

( * ) Notice: Subject to any disclaimer, the term of this patent is extended or adjusted under 35 U.S.C. 154(b) by 0 days.

(21) Appl. No.: 16/892,278

(22) Filed: Jun. 3, 2020

(65) Prior Publication Data

US 2021/0085042 A1 Mar. 25, 2021

(30) Foreign Application Priority Data

Sep. 24, 2019 (CN) ..... 201910905984.0

(51) Int. Cl.
*A45B 9/00* (2006.01)
*A45B 9/02* (2006.01)
*A45B 9/04* (2006.01)

(52) U.S. Cl.
CPC ..... *A45B 9/02* (2013.01); *A45B 9/04* (2013.01); *A45B 2009/005* (2013.01); *A45B 2009/007* (2013.01)

(58) Field of Classification Search
CPC .. A45B 9/00; A45B 2009/005; A63B 2210/52
USPC ..... 135/74
See application file for complete search history.

(56) References Cited

U.S. PATENT DOCUMENTS 4,869,280 A * 9/1989 Ewing ..... A61H 3/02 135/69
7,434,592 B2 * 10/2008 Larson ..... A61H 3/02 135/72
7,841,353 B2 * 11/2010 Lee ..... A45B 9/00 135/74
8,297,870 B2 * 10/2012 Lenhart ..... A63C 11/221 403/109.5
2008/0041432 A1 * 2/2008 Willis ..... A45B 9/04 135/74

(Continued)

FOREIGN PATENT DOCUMENTS

CN 201088205 7/2008
EP 3666349 A1 * 6/2020 ..... A45B 7/00

*Primary Examiner* — Noah Chandler Hawk
(74) *Attorney, Agent, or Firm* — JCIP Global Inc.

(57) ABSTRACT

A locking mechanism is adapted for a foldable pole including a pole body and an elastic drawstring disposed therein, and the pole body being composed of a plurality of pole sections foldably connected with each other through the locking mechanism. The locking mechanism includes a connector and a connecting sleeve. The connecting sleeve is disposed on one end of adjacent two ends of two pole sections and the connector is disposed on another end of adjacent two ends of two pole sections. The connecting sleeve has a through hole for receiving the connector. An elastic buckle for locking the connector is disposed on the connecting sleeve. One end of the elastic buckle passes through the connecting sleeve and is inserted into the clamping groove of the connector. The locking sleeve is pressable against the elastic buckle so as to lock or unlock the connecting sleeve with the connector.

26 Claims, 13 Drawing Sheets

(56) References Cited

U.S. PATENT DOCUMENTS

| | | | | |
|---|---|---|---|---|
| 2013/0312797 | A1* | 11/2013 | Lah | A45B 19/08 135/74 |
| 2014/0069475 | A1* | 3/2014 | Lenhart | A45B 9/02 135/74 |
| 2015/0059816 | A1* | 3/2015 | Kim | A45B 9/00 135/75 |

* cited by examiner

LOCKING MECHANISM FOR FOLDABLE POLE AND FOLDABLE POLE

CROSS-REFERENCE TO RELATED APPLICATION

This application claims the priority benefit of China application serial no. 201910905984.0, filed on Sep. 24, 2019. The entirety of the above-mentioned patent application is hereby incorporated by reference herein and made a part of this specification.

BACKGROUND

Technical Field

The present invention relates to the technical field of poles, and in particular to a locking mechanism for a foldable pole and a foldable pole, which is applicable to various poles such as mountaineering poles, ski poles and hiking poles.

Description of Related Art

In the prior art, the poles such as mountaineering poles and ski poles are mainly used to aid walking and provide support. The conventional poles are usually integral poles that are long, large in size, and inconvenient for storage or transport. In view of those disadvantages, many telescopic poles and foldable poles have been proposed. A telescopic pole generally includes a main tube and an extended tube, the extension/retraction of which is positioned by an extension/retraction positioning device to reduce the size. However, this structure is relatively complicated, high in manufacturing cost, and difficult to repair after being damaged.

A foldable pole generally consists of multiple pole sections and an elastic drawstring running through the multiple pole sections. For example, Chinese Patent Publication of CN201088205Y (Application No. 200720058870.X) disclosed a shock absorption structure for a foldable pole, wherein the pole includes a first pole section, a second pole section and an elastic drawstring. The elastic drawstring runs through central holes of the first pole section and the second pole section to maintain and connect the first pole section and the second pole section. An internal step is arranged in the central hole of the first pole section, and a compression spring is arranged in an accommodating groove of the second pole section sheathed on a butt-joint end of the first pole section. The butt-joint end of the first pole section is butted with the compression spring, so that the second pole section and the first pole section float relatively in an axial direction. A clamping point formed on the elastic drawstring exactly clamps the internal step of the first pole section, so that the elastic drawstring pulls the first pole section toward the second pole section when it is retracted. The foldable pole is simple in structure, and is convenient for storage after being folded. However, the pole has no locking mechanism, and the first pole section and the second pole section are not locked and fixed by a locking mechanism after they are butted with each other. As a result, the structure is not firm enough, easy to unfold when in use, and not safe and reliable enough.

Furthermore, although a foldable pole can be folded for ease of storage, it is easy for the pole to get itself unfolded since it is not fixed after being folded. Therefore, to carry around the foldable pole, it is necessary to tie the sections of the pole together by a rope. It is inconvenient to use.

SUMMARY

A first object of the present invention is to provide a locking mechanism for a foldable pole, with rational structure, convenient operation, and stable and safe connection.

A second object of the present invention is to provide a foldable pole using the locking mechanism.

A third object of the present invention is to provide a foldable pole which is simple in structure, easy to operate and convenient in storage.

The above first object is achieved through following technical solution. The locking mechanism for a foldable pole, the foldable pole comprising a pole body and an elastic drawstring disposed inside the pole body, the pole body being composed of a plurality of pole sections foldably connected with each other through the locking mechanism, and each pole section having two ends. The locking mechanism comprises a connector, a connecting sleeve with a through hole for receiving the connector, an elastic buckle disposed on the connecting sleeve for locking the connector, and a locking sleeve limitedly and movably up and down disposed out of the connecting sleeve. The connecting sleeve is disposed on one end of adjacent two ends of two pole sections, and the connector is disposed on another end of the adjacent two ends of two pole sections. The connector has a clamping groove corresponding to the elastic buckle. One end of the elastic buckle passes through the connecting sleeve and is inserted into the clamping groove of the connector, so as to lock the connecting sleeve with the connector. The locking sleeve is capable of pressing against the elastic buckle so as to lock or unlock the connecting sleeve with the connector.

As one of preferred solutions, the connecting sleeve has an upper portion and a lower portion. The upper portion of the connecting sleeve is connected with a cylindrical connecting section, and an end of an upper pole section has an opening for receiving the cylindrical connecting section. The elastic buckle is a spring piece or an elastic piece with a substantially V-shaped or U-shaped cross section, and has a fixed end and an elastic locking end. The connecting sleeve has a mounting base protruding from a peripheral surface of the lower portion of the connecting sleeve for receiving the fixed end of the elastic buckle, and a slot is formed in the mounting base for the elastic locking end of the elastic buckle to pass therethrough and to resist against the clamping groove of the connector, so that elastic buckle is locked with the connector inside the connecting sleeve under pressure of the locking sleeve. The clamping groove is annular and is formed on a peripheral surface of the connector.

As another one of preferred solutions, the connecting sleeve is disposed on an end of an upper pole section of the adjacent two pole sections, and the connector is disposed on an end of a lower pole section of the adjacent two pole sections. The connecting sleeve has an upper portion, a middle portion and a lower portion. The end of the upper pole section has an opening for receiving the upper portion of the connecting sleeve which is a cylindrical connecting section with a diameter matching with the opening of the end of the upper pole section and is connected with the upper pole section. The lower portion of the connecting sleeve has a diameter greater than that of the upper portion of the connecting sleeve, and the middle portion of the connecting sleeve is a step for resisting against the end of the upper pole section. The elastic buckle is a spring piece or an elastic piece with a substantially V-shaped or U-shaped cross section, and has a fixed end and an elastic locking end. The connecting sleeve has a mounting base protruding from a peripheral surface of the lower portion of the connecting sleeve for receiving the fixed end of the elastic buckle, and a slot is formed in the mounting base for the elastic locking end of the elastic buckle to pass therethrough and to resist against the clamping groove of the connector, so that elastic buckle is locked with the connector inside the connecting sleeve under pressure of the locking sleeve. The clamping groove is annular and is formed on a peripheral surface of the connector.

Preferably, multiple of the elastic buckles disposed on the peripheral surface of the connecting sleeve with a same interval; the connecting sleeve has multiple mounting bases disposed with a same interval.

Preferably, two elastic buckles symmetrically disposed on the peripheral surface of the connecting sleeve; the connecting sleeve has two symmetrically disposed mounting bases.

Preferably, the cylindrical connecting section is a lining tube joint connected with the end of the upper pole section. A fixed sleeve is disposed on the lining tube joint, and an outer diameter of the fixed sleeve is greater than the outer diameter of the upper pole section. The locking sleeve is disposed outside the connecting sleeve, the locking sleeve has a stepped inner hole with an upper portion and a lower portion, and the upper portion of the stepped hole has a greater diameter than that of the lower portion of the stepped hole. A compression spring is disposed between the fixed sleeve and a stepped inner wall of the stepped inner hole of the locking sleeve, so as to keep the locking sleeve to move downward to press the elastic buckle inward to lock the connector.

Preferably, a fixed sleeve is disposed on the upper pole section corresponding to the upper portion of the connecting sleeve, and an outer diameter of the fixed sleeve is greater than that of the mounting base of the connecting sleeve. The locking sleeve is disposed outside the fixed sleeve and the connecting sleeve, the locking sleeve has a stepped inner hole with an upper portion matching with the fixed sleeve and a lower portion matching with the mounting base, the upper portion of the stepped hole has a greater diameter than that of the lower portion of the stepped hole. An inner wall of the lower portion of the stepped inner hole is resisted against the elastic buckle. A compression spring is disposed between the fixed sleeve and a stepped inner wall of the stepped inner hole of the locking sleeve, so as to keep the locking sleeve to move downward to press the elastic buckle inward to lock the connector.

Preferably, a guide groove fitted with the mounting bases is formed on an inner wall of a lower portion of the locking sleeve, and the locking sleeve has an inclined slope formed on an inner surface of the guide groove for resisting against the elastic buckle. When the locking sleeve is pushed upward, the inclined slope separates from elastic buckle, the locking sleeve releases the pressure to the elastic buckle, and the elastic locking end of the elastic buckle moves outward from the slot and apart from the connector, so as to unlock the connector.

Preferably, the locking sleeve has multiple elastic teeth formed on an inner wall of the lower portion of stepped inner hole, and the connecting sleeve has a limiting edge extending from a lower end of the connecting sleeve, which can block the elastic teeth so as to limit the locking sleeve on the connecting sleeve.

Preferably, the locking sleeve has two recesses at two sides of an outer surface of the lower portion of the locking sleeve.

Preferably, the connector comprises a fixed socket and a plug; the fixed socket is inserted into an upper opening of a lower pole section by dimensional fit. An upper end of the fixed socket has an annular flange resisted against an outer side of the upper opening of the lower pole section; the plug is divided into three sections including a cylindrical upper section, a cylindrical lower section with an increased diameter, and a middle transition section with a truncated-cone shape. The lower section of the plug is fixed in the fixed socket; and the clamping groove is annularly formed in the lower section of the plug.

Preferably, a diameter of the annular flange is greater than an inner diameter of the locking sleeve. After the connecting sleeve is fixedly inserted in the connector, the locking sleeve is resisted against the annular flange. A positioning convex ring is formed on an inner wall of the fixed socket at a position corresponding to the annular flange. A corresponding annular positioning groove is formed on an outer wall of the plug; the lower section of the plug is inserted and fixed in the fixed socket to be fitted with the positioning convex ring through the annular positioning groove. A lower end of the plug is basically flush with the lower end of the fixed socket.

Preferably, an inner sleeve is fixedly surrounded on an inner wall of an upper portion of the connecting sleeve, and the inner sleeve has truncated-cone holes matching with the upper section and the middle section of the plug.

Preferably, the connector is hollow; one end of the elastic drawstring is fixed inside an uppermost pole section of the pole body, the other end of the elastic drawstring passes through each of the pole sections of the pole body, each connecting sleeve and the connector to be connected with the connector on a lowermost pole section.

The above second object is achieved through following technical solution. A foldable pole comprises a handle, a pole body, a support leg, and a plurality of the abovementioned locking mechanism disposed on the pole body, wherein the pole body is composed of a plurality of pole sections foldably connected with each other through the locking mechanism.

The above second object is achieved through following technical solution. Preferably, the foldable pole further comprises a binding ring having two ends and a retainer. One end of the binding ring is connected with one side of the retainer, and the other end of the binding ring surrounds the folded pole sections and rings on the retainer to bind the folded pole sections.

Preferably, the retainer is disposed on an uppermost pole section or on the handle.

Preferably, the retainer comprises an inner ring and an outer ring connected with each other, the inner ring is fixedly disposed on the uppermost pole section or on the handle, and the outer ring is C-shaped and has an opening forming two arc retaining grooves at two ends thereof.

Preferably, the binding ring is an elastic ring, one end of which is retained in one of the retaining grooves, and the other end of which is retained in the other one of the retaining grooves.

Preferably, the retainer is disposed on the handle, and the retainer divides the handle into two parts for hand-holding.

Preferably, the retainer is integrally connected to the handle.

Preferably, the binding ring is an elastic ring with a button.

Preferably, the binding ring has a grip for holding with a hand.

Compared with the prior art, the present invention has the following advantages. The locking mechanism includes a connector, a connecting sleeve and a locking sleeve. The elastic buckles in locking fit with the connector are arranged in the connecting sleeve, and the locking sleeve can slide up and down. The locking and unlocking of the elastic buckles and the connector are realized by squeezing. When in use, simply by pushing the locking sleeve upward, the elastic buckles are separated from the connector, and the pole body can be folded. When connection is required, simply by aligning the connector with the connecting sleeve, the connector and the connecting sleeve are automatically locked due to the action of the elastic drawstring and the locking sleeve. Particularly, the elastic buckles are V-shaped or U-shaped spring pieces or elastic pieces, so that the action flexibility of the locking device is greatly improved, and the operation is convenient and flexible. By the arrangement of the lining tube joint in the upper pole section, it is convenient to arrange the fixed sleeve without requiring any lining metal member for the connecting sleeve. The connector is directly fitted with the lining tube joint. The production of inserts for the connecting sleeve is avoided, and the appearance processing of the connector is simplified. The strength of products becomes better by the fitting of the connector with the lining tube joint. Of course, an inner sleeve may be arranged in the connecting sleeve, the connector is stabilized during its insertion and the connection strength is improved. By the arrangement of the retainer on the handle or on the first pole section, the pole sections are tied together by the binding ring after they are folded. In this way, it is less likely for the folded pole to get itself unfolded and it is thus convenient for carrying. In addition, a positioning collar is further arranged to ensure more stable and reliable connection. The present invention is simple and rational in structure and convenient to operate. The pole sections can be automatically locked after being connected, so that the disconnection is avoided and the safety and stability in use are greatly improved. Moreover, the pole body is foldable, so it is convenient to carry and store.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
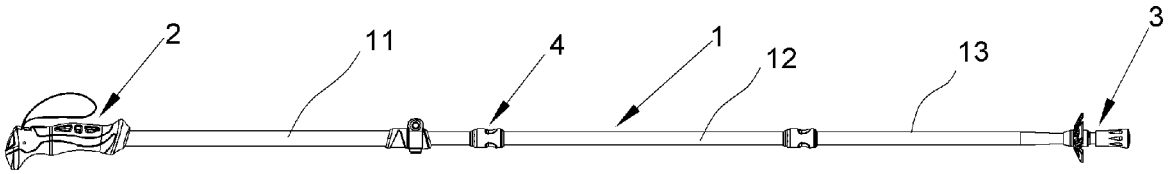
FIG. 1 is a perspective view of a foldable pole (using a non-telescopic pole) with a locking mechanism according to an Embodiment 1 of the present invention.

To enable a further understanding of the present invention content of the invention herein, refer to the detailed description of the invention and the accompanying drawings below.

Embodiment 1

FIG. 1 to FIG. 7 show a preferred embodiment of the locking mechanism for a foldable pole. The foldable pole comprises a pole body 1, a handle 2 is arranged at an upper end of the pole body 1, and a support leg 3 is arranged at a lower end of the pole body 1. These are conventional designs. The pole body is formed by connecting three pole sections 11, 12 and 13 through the locking mechanism 4 in a foldable manner. Of course, more pole sections may also be used. In this embodiment, each pole section is configured as a non-telescopic pole structure having tubes with fixed length. An elastic drawstring 5 disposed inside the pole body 1 to form a mountaineering pole. Generally, each pole section may be a tube made of aluminum alloy, stainless steel, carbon fiber or other materials, and the section of each pole section may be circular. The locking mechanism 4 comprises a connecting sleeve 41, a connector 42 and a locking sleeve 43. A main body of the connecting sleeve 41 is made of plastics, and has a metal member embedded therein. A main body of the connector 42 is a metal tube. A part of the metal tube is coated with plastics to form a fixed socket. The locking sleeve 43 is generally made of plastics, so that the locking sleeve 43 has a certain elastic tensioning force and is conveniently assembled and fixed in the metal tube of each pole section. The connecting sleeve 41 is disposed on one end of adjacent two ends of two pole sections. Correspondingly, the connector 42 is disposed on another end of adjacent two ends of two pole sections. The connecting sleeve 41 is formed with a through hole for receiving the connector 42. The connector 42 is of a hollow structure. One end of the elastic drawstring 5 is fixed inside the uppermost pole section of the pole body 1, while the other end thereof passes through each pole section of the pole body 1, each connecting sleeve 41 and the connector 42 to be fixed at the connector 42 on a third pole section 13 (i.e., the lowermost pole section). An upper end of the elastic drawstring 5 is fixed in the tube of an uppermost pole section by a tube stopper. In this embodiment, the upper end of the elastic drawstring 5 is fixed in the upper opening of the lower tube in an uppermost pole section 11 by a tube stopper. A lower end of the elastic drawstring 5 passes through the connector 42 on the lowermost pole section 13 and is then tied for fixation. Elastic buckles 40 for locking the inserted connector 42 are arranged in the connecting sleeve 41. The elastic buckles 40 are metal spring pieces or elastic pieces made of plastics by injection molding. The locking sleeve 43 is slidingly sheathed outside the connecting sleeve 41 in an up-down limiting manner. An inner wall of the locking sleeve 43 may press or not press the elastic buckles 40 to lock or unlock the connecting sleeve 41 and the connector 42.

The specific structure will be described below. An upper portion of the connecting sleeve 41 is connected with a cylindrical connecting section 411, and an end of the uppermost pole section 11 has an opening for receiving the cylindrical connecting section 411. The cylindrical connecting section 411 is sheathed and fixed in a lower opening of the uppermost pole section 11 by dimensional fit. A step 414 (generally an annular step) resisted against an outer side of the lower opening of the upper pole section is formed in the middle of the connecting sleeve 41. The connecting sleeve 41 has an U-shaped mounting base 412 protruding from a peripheral surface of a lower portion of the connecting sleeve 41 for receiving a fixed end 401 of the elastic buckle 40, and a slot 413 is formed in the mounting base 412 for the elastic locking end 402 of the elastic buckle 40 to pass therethrough and to resist against the clamping groove 420 of the connector 42. The elastic buckle 40 is a spring piece or an elastic piece with a substantially V-shaped or U-shaped cross section, and has the fixed end 401 and an elastic locking end 402. Of course, the cross section is not limited to these shapes. An end of each elastic buckle 40 is bent to form the fixed end 401 with a relatively large length, and the other end thereof is also bent to form the elastic locking end 402 with a relatively small length. There are two elastic buckles 40 arranged symmetrically. The elastic buckle 40 is locked with the connector 42 inside the connecting sleeve 41 under the pressure of the locking sleeve 43. A fixed sleeve 44 is disposed on the uppermost pole section 11 corresponding to the upper portion of the connecting sleeve 41. The fixed sleeve 44 is not limited to be fixed on the uppermost pole section 11 by glue. It is also possible that a surface of the uppermost pole section 11 protrudes out from the fixed hole point to be fitted on the convex point on the fixed sleeve 44, so that the fixed sleeve 44 is fixed. An outer diameter of the fixed sleeve 44 is greater than that of the mounting base 412 of the connecting sleeve 41. The locking sleeve 43 is disposed outside the fixed sleeve 44 and the connecting sleeve 41, and can slide upward and downward in a limiting manner. The locking sleeve 43 has a stepped inner hole 434 with an upper portion matching with the fixed sleeve 44 and a lower portion matching with the mounting base 412, the upper portion of the stepped hole 434 has a greater diameter than that of the lower portion of the stepped hole 434, and, a compression spring 45 is disposed between the fixed sleeve 44 and a stepped inner wall of the stepped inner hole 434 of the locking sleeve 43. Generally, the compression spring 45 is sheathed outside the uppermost pole section 11. In this way, the stepped inner wall of the stepped inner hole 434 of the locking sleeve 43, so as to keep the locking sleeve 43 to move downward to press the elastic buckle 40 inward to lock the connector 42. The locking sleeve 43 has two recesses 432 at two sides of the outer surface of the lower portion of the locking sleeve 43. It is convenient for the operator to push with a finger. A guide groove 433 fitted with the mounting bases 412 is formed on the inner wall of the lower portion of the locking sleeve 43, the locking sleeve 43 has an inclined slope 431 formed on the inner surface of the guide groove 433 for resisting against the elastic buckle 40. When the locking sleeve 43 is pushed upward, the inclined slope 431 separates from elastic buckle 40, the locking sleeve 43 releases the pressure to the elastic buckle 40, and the elastic locking end 402 of the elastic buckle 40 moves outward from the slot 413 and apart from the connector 42, so as to unlock the connector 42.

The connector 42 comprises a fixed socket 422 and a plug 421. The fixed socket 422 is inserted into the upper opening of the lower pole section by dimensional fit. An upper end of the fixed socket 422 has an annular flange 423 resisted against the outer side of the upper opening of the lower pole section; the plug 421 is divided into three sections, i.e., a cylindrical upper section, a cylindrical lower section with an increased diameter, and a truncated-cone middle transition section. The upper section of the plug 421 is fixed in the fixed socket 422; and, the clamping groove is annularly formed in the lower section of the plug 421. The diameter of the annular flange 423 is greater than an inner diameter of the locking sleeve 43. After the connecting sleeve is inserted in the connector and then fixed, the locking sleeve 43 is resisted against the annular flange 423. A positioning convex ring 424 is formed on the inner wall of the fixed socket 422 at a position corresponding to of the annular flange 423. A corresponding annular positioning groove 425 is formed on an outer wall of the plug 421. The lower section of the plug 421 is inserted and fixed in the fixed socket 422 to be fitted with the positioning convex ring 424 through the annular positioning groove 425, and, the lower end of the plug 421 is basically flush with the lower end of the fixed socket 422. An inner sleeve 46 is fixedly surrounded on the inner wall of the upper portion of the connecting sleeve, and the inner sleeve 46 has truncated-cone holes matching with the upper portion and middle section of the plug 421. The arrangement of the inner sleeve 46 is to improve the connection strength and stability. The inner sleeve 46 is generally made of metal such as aluminum.

Figure 2:
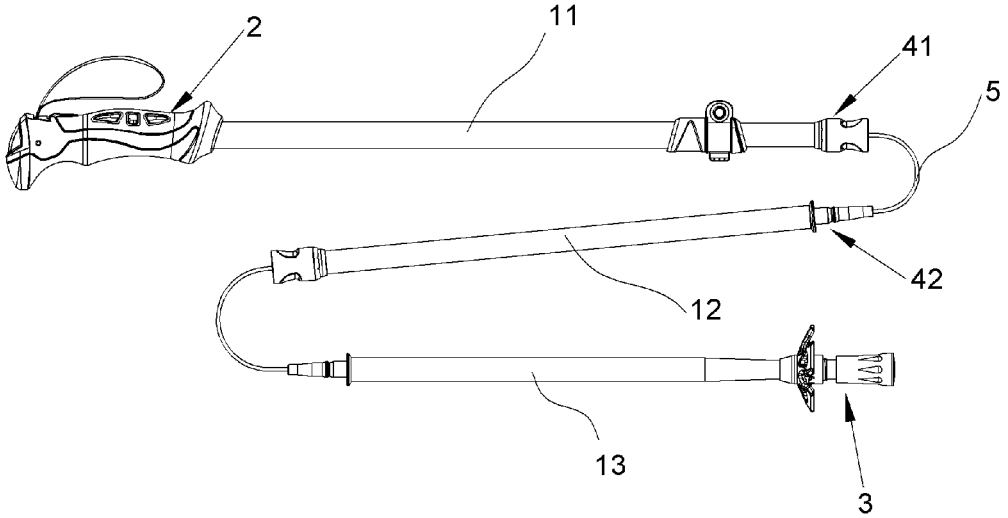
FIG. 2 is a perspective view of the foldable pole in a folded state according to the Embodiment 1 of the present invention.
Figure 3:
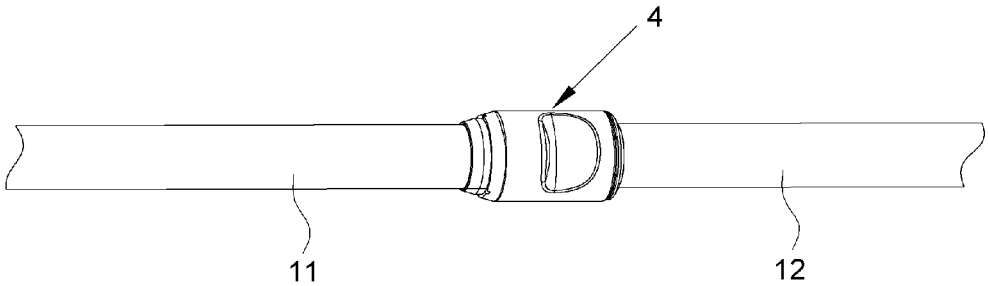
FIG. 3 is a perspective view of two pole sections in a locked state according to the Embodiment 1 of the present invention.
Figure 4:
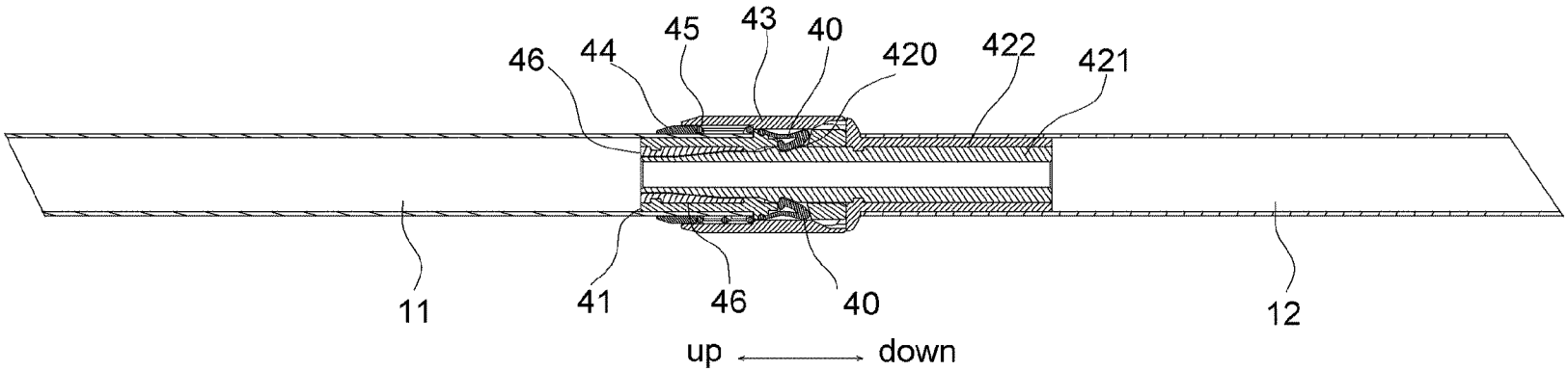
FIG. 4 is a sectional view of FIG. 3.
Figure 5:
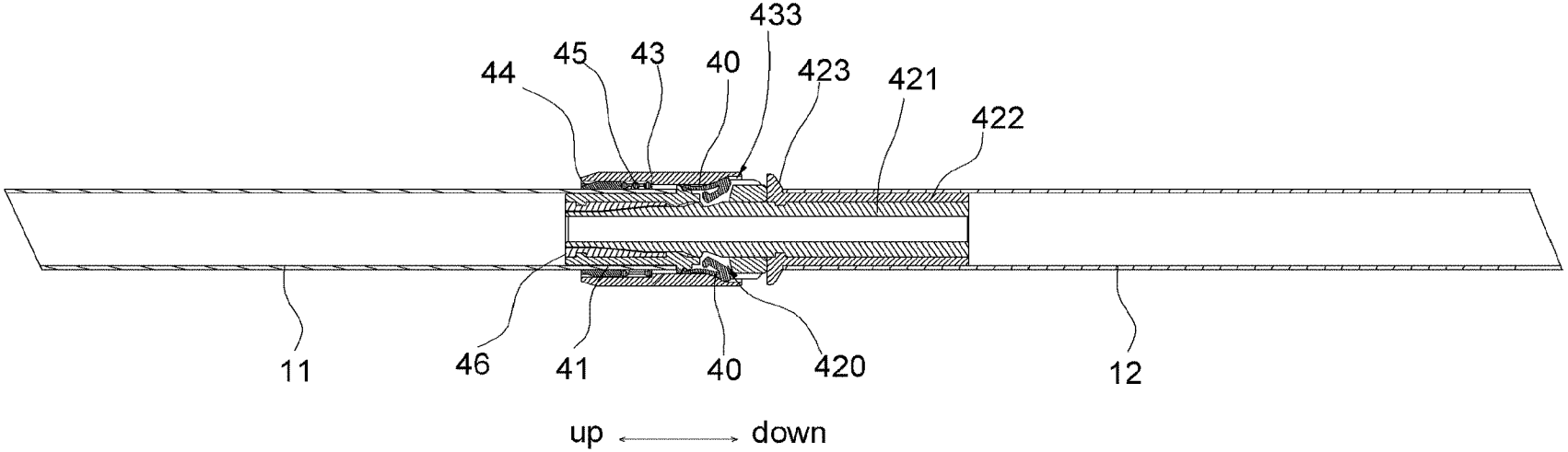
FIG. 5 is a sectional view of FIG. 4 when a locking sleeve is moved upward and in an unlocked state.
Figure 6:
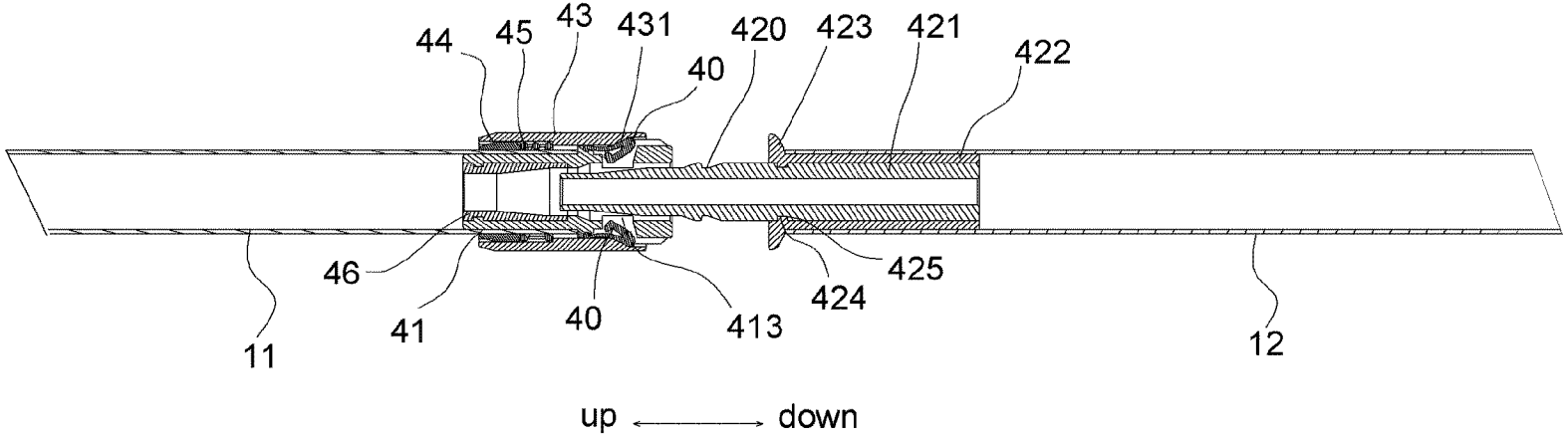
FIG. 6 is a sectional view of FIG. 5 when a connecting sleeve and a connector are separated.
Figure 7:
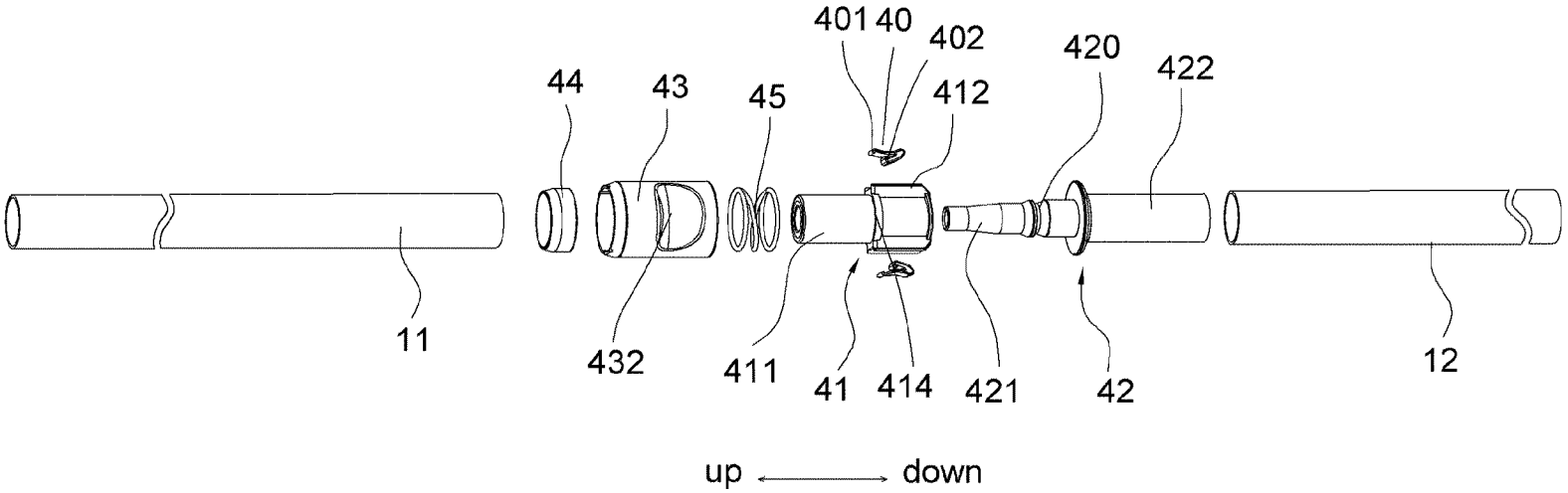
FIG. 7 is an exploded view of FIG. 3.

When the pole is not used, the locking sleeve 43 may be pushed upward. At this time, the locking sleeve 43 unlocks the elastic buckles 40, and the elastic locking ends 402 of the elastic buckles 40 bound up to be separated from the annular clamping groove 420. The two pole sections are pulled, so that the connector 42 can be pulled out from the connecting sleeve 41, and each of the pole sections can be folded, as shown in FIG. 2, so it is convenient to carry and store. When the pole is to be used, simply by aligning the connector 42 with the connecting sleeve 41 and inserting it therein, the elastic buckles 40 can be clamped into the annular clamping groove 420 through the slot 413, and the locking sleeve 43 can squeeze the elastic buckles 40 due to the compression spring 45 so that the elastic locking ends 402 of the elastic buckles 40 are resisted against the annular clamping groove 420 to lock the connecting sleeve 41 and the connector 42. In this way, the two pole sections are connected and fixed, and the pole can be used after the pole body 1 is expanded, as shown in FIG. 1.

Figure 8:
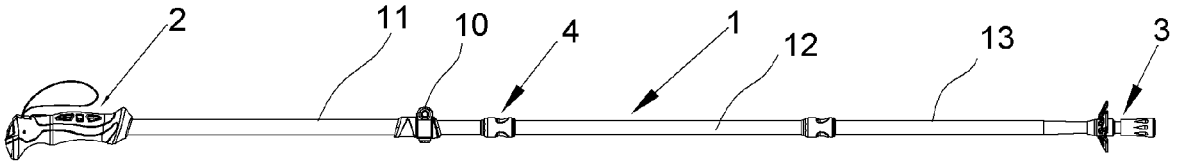
FIG. 8 is a perspective view of another foldable pole (using a telescopic pole) with the locking mechanism according to the Embodiment 1 of the present invention.
Figure 9:
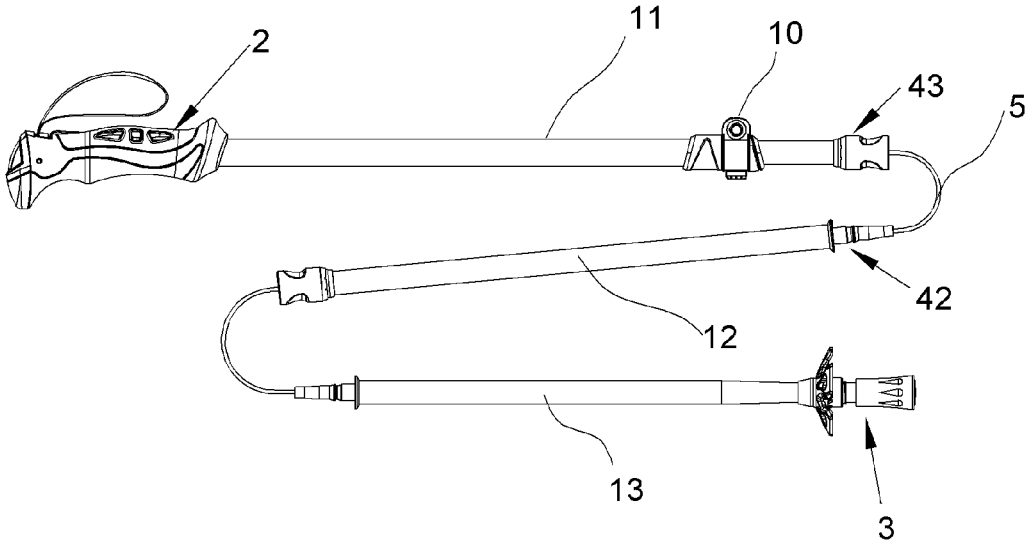
FIG. 9 is a perspective view of another foldable pole (using a telescopic pole) with the locking mechanism in a folded state according to the Embodiment 1 of the present invention.
Figure 10:
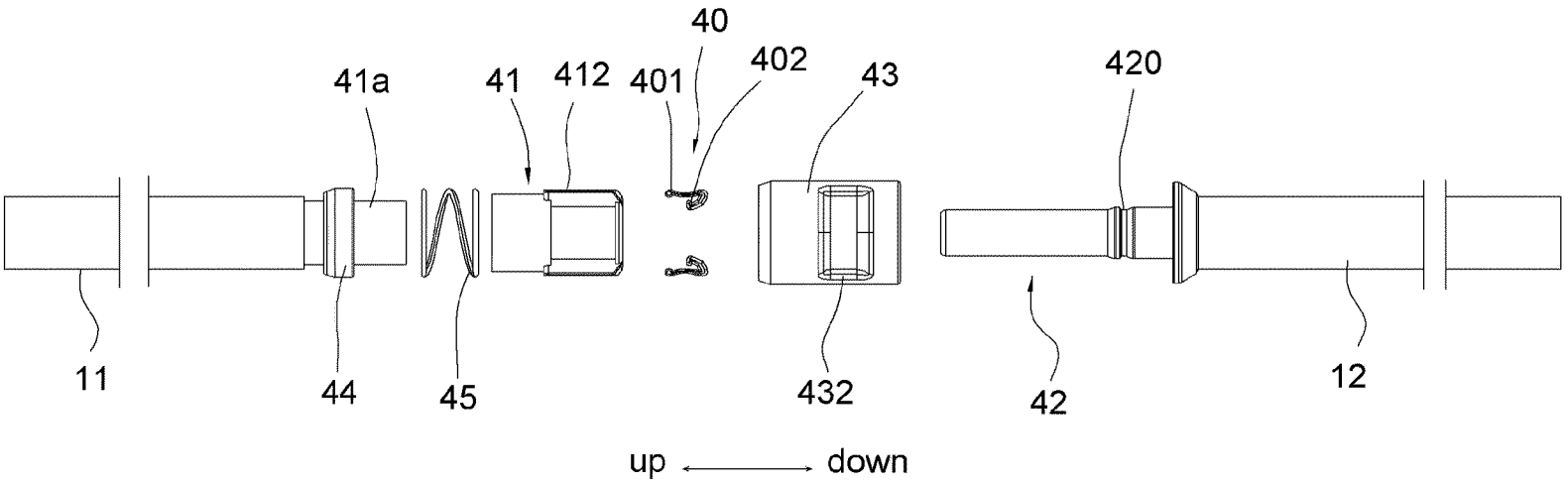
FIG. 10 is an exploded view of a foldable pole with a locking mechanism according to an Embodiment 2 of the present invention.
Figure 11:
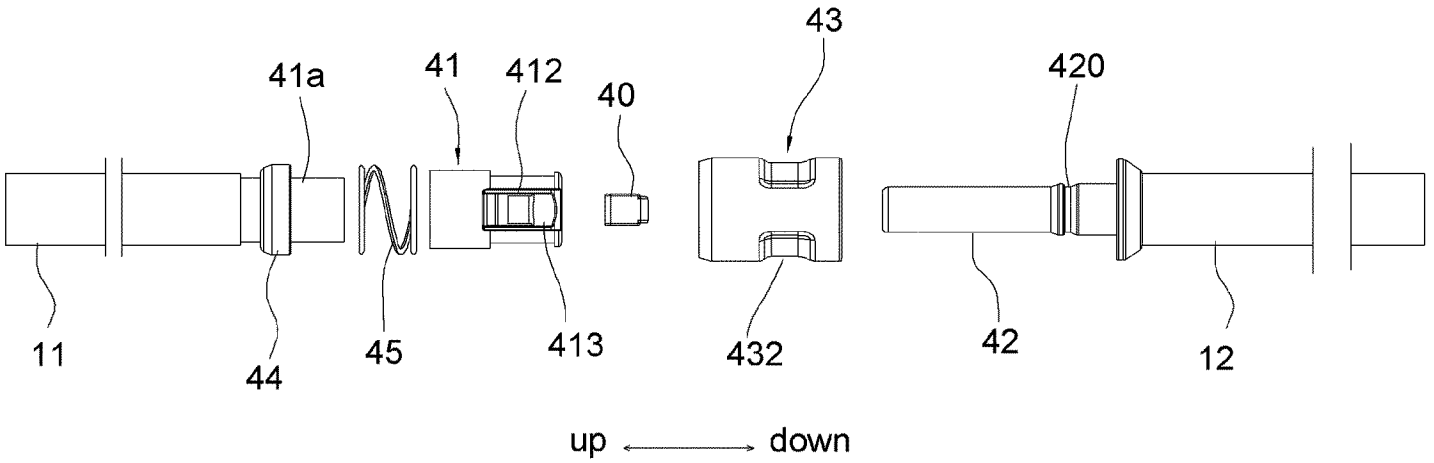
FIG. 11 is another exploded view of FIG. 10.
Figure 12:
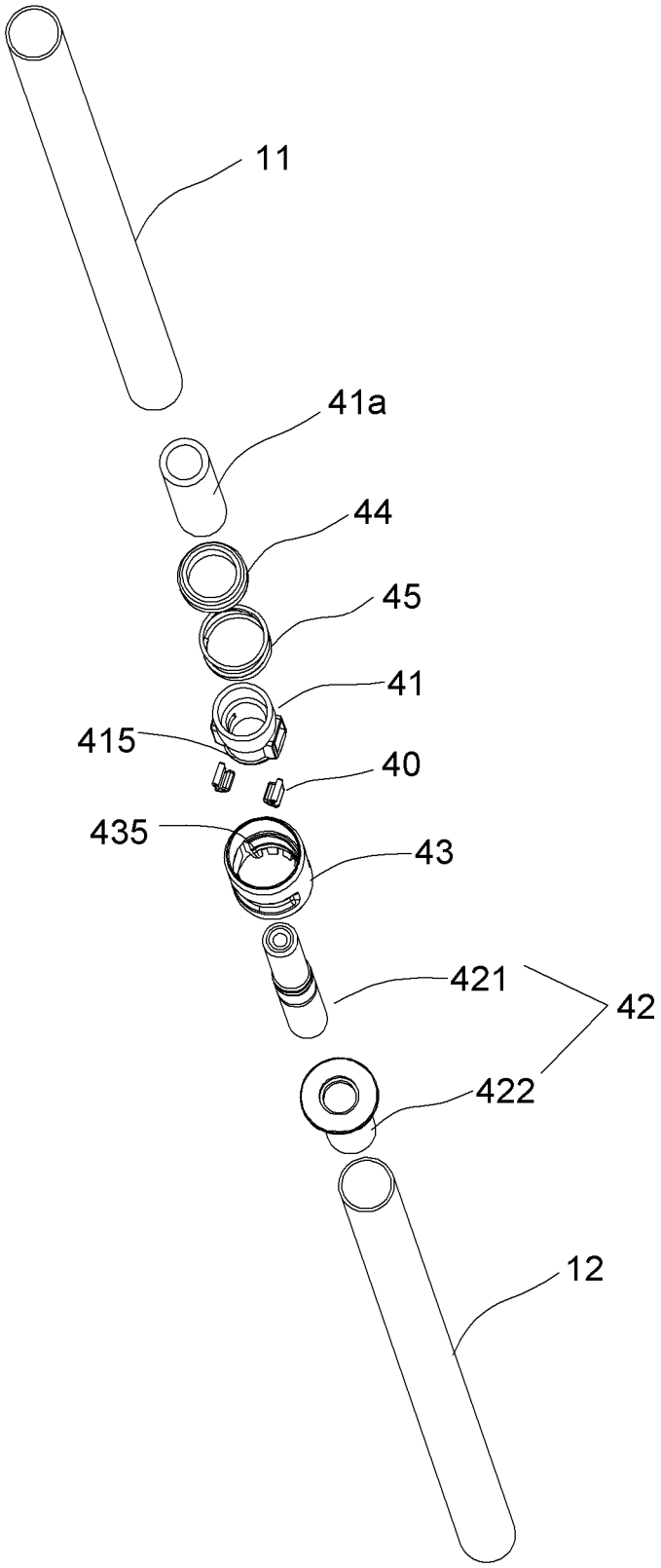
FIG. 12 is another exploded view of FIG. 10.
Figure 13:
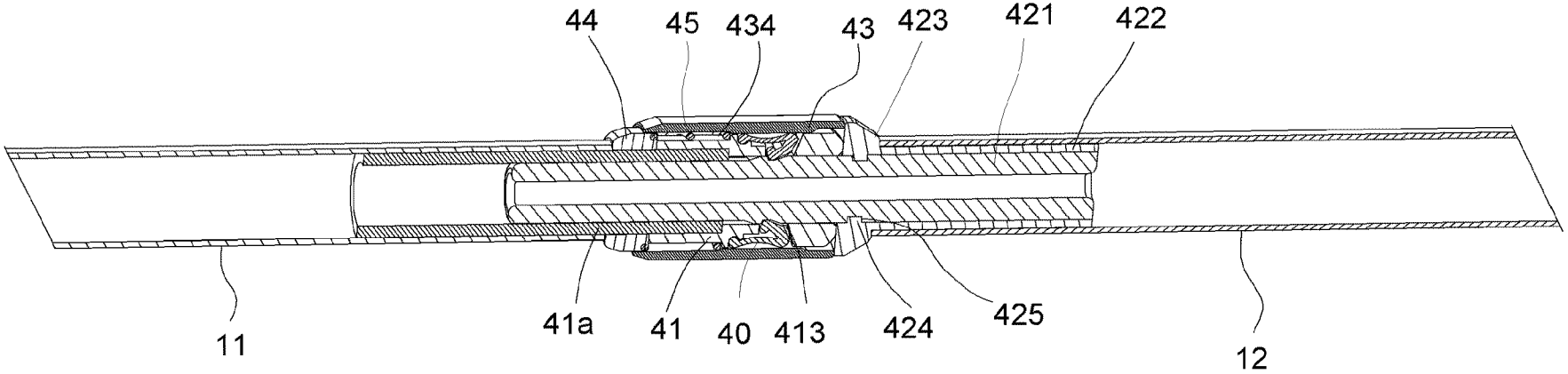
FIG. 13 is a sectional view of two pole sections with the locking mechanism in a locked state according to the Embodiment 2 of the present invention.
Figure 14:
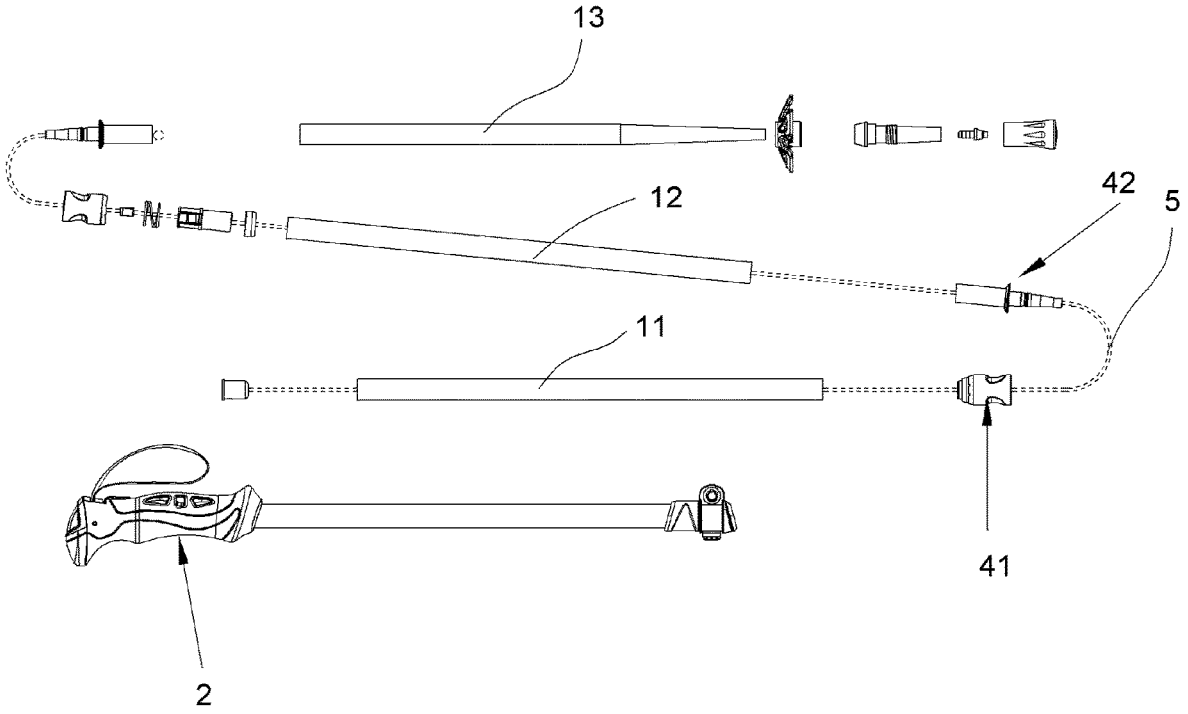
FIG. 14 is a exploded view of a foldable pole with a locking mechanism according to an Embodiment 3 of the present invention.

As shown in FIG. 8 to FIG. 9, in this embodiment, the uppermost pole section 11 is a telescopic pole. That is, the uppermost pole section 11 is a telescopic tube having an adjustable length. An extension and retraction locking mechanism 10 is arranged between the upper tube and the lower tube of the telescopic tube to lock the tube after its height has been adjusted. This is a conventional design. Corresponding, the upper end of the elastic drawstring 5 is fixed in an upper opening of the lower tube of the uppermost pole section 11 by a tube stopper. The others are the same as the locking mechanism 4 in the case of using a non-telescopic pole in Embodiment 1, and will not be repeated here for brevity.

Embodiment 2

As shown in FIG. 10 to FIG. 13, the difference between this embodiment and the Embodiment 1 is that the connection and fixation structure of the connecting sleeve 41 with the upper pole section is different. In the Embodiment 1, the connecting sleeve 41 is directly disposed on the end of the upper pole section. In the Embodiment 2, the connecting sleeve 41 disposed on the end of the upper pole section by other components. A stepped hole is formed in the upper section of the connecting sleeve 41 and is sheathed and fixed on the cylindrical connecting section 411 with a diameter matching with the opening of the end of the upper pole section. The cylindrical connecting section is a lining tube joint 41*a* connected with the end of the uppermost pole section 11, a fixed sleeve 44 is disposed on the lining tube joint 41*a*, the outer diameter of the fixed sleeve 44 is greater than an outer diameter of the uppermost pole section 11, and an inner diameter of the fixed sleeve 44 is less than a tube diameter of the uppermost pole section 11 so that the fixed sleeve 44 can be kept at the edge of the opening of the uppermost pole section 11. In this way, the connecting sleeve 41 is indirectly fixed on the lower opening of the uppermost pole section 11. It is convenient to arrange the fixed sleeve 44, without requiring any lining metal member for the connecting sleeve 41. The connector 42 is directly fitted with the lining tube joint 41*a*. The production of inserts for the connecting sleeve is avoided, and the appearance processing of the connector is simplified. The strength of products becomes better by the fitting of the connector with the lining tube joint. In addition, the locking sleeve 43 has multiple elastic teeth 435 formed on the inner wall of the lower portion of stepped inner hole 434, correspondingly, the connecting sleeve 41 has a limiting edge extending from the end of the connecting sleeve 41, which can block the elastic teeth 435 so as to limit the locking sleeve 43 on the connecting sleeve 41. Usually, the curved edges 415 are distributed between the side walls of the mounting bases 412. In this way, after the locking sleeve 43 slides into the connecting sleeve 41, the elastic teeth 435 and the curved edges 415 are resisted against each other to realize the purpose of limiting. The compression spring 45 enables the locking sleeve to have a trend to bounce off downward, but not separate from the connecting sleeve 41. Of course, this limiting structure may be applicable to the Embodiment 1. The others are the same as those in the Embodiment 1.

Embodiment 3

As shown in FIG. 14 to FIG. 23, a foldable pole comprises a foldable pole body 1. A handle 2 is arranged at an upper end of a first pole section 11 of the pole body 1. The pole body 1 is usually formed by connecting, in a foldable manner, two to six pole sections by a locking mechanism 4 and a drawstring (usually, elastic drawstring 5). The handle 2 is arranged at the upper end of the first pole section 11, i.e., the uppermost pole section of the pole body 1. An elastic drawstring 5 for connecting the pole sections is arranged in the pole body 1. The folding structure of the pole body 1 is similar to that of the existing foldable poles, and will not be repeated herein. The description of the locking mechanism 4 refers to the description of the Embodiment 1 or the Embodiment 2.

Figure 18:
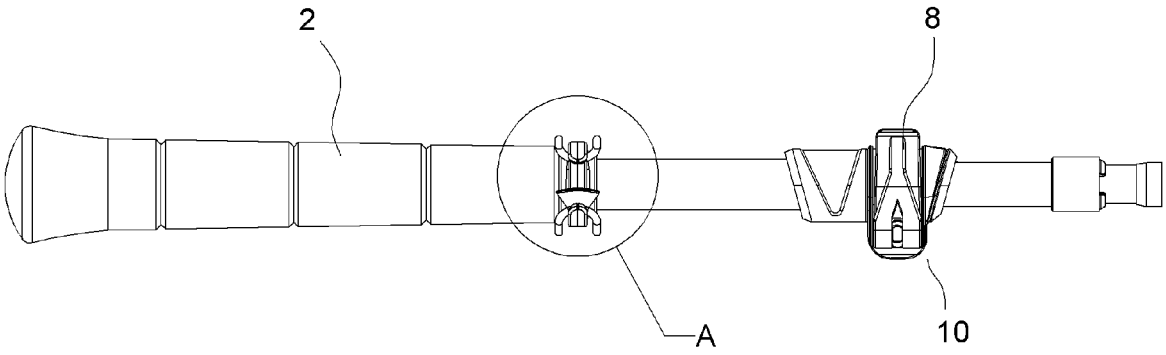
FIG. 18 is a perspective view of a handle and a first pole section according to the Embodiment 3 of the present invention.
Figure 19:
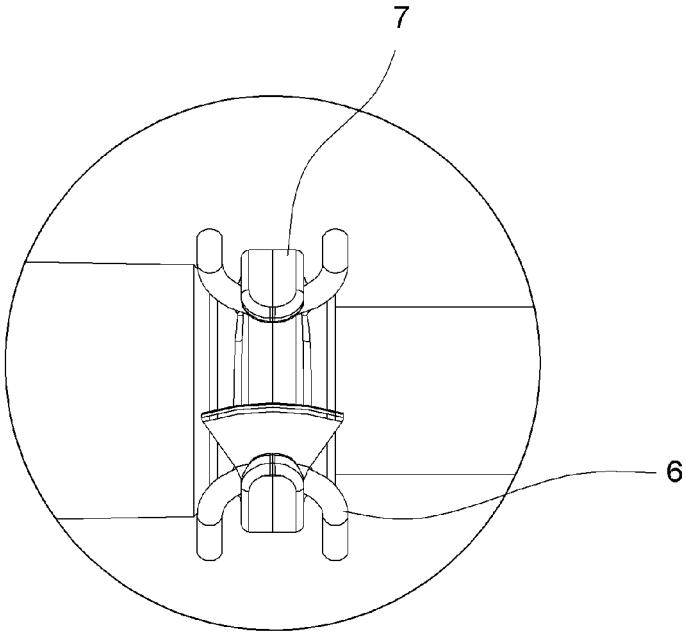
FIG. 19 is a partially enlarged view of Part-A of FIG. 18.
Figure 20:
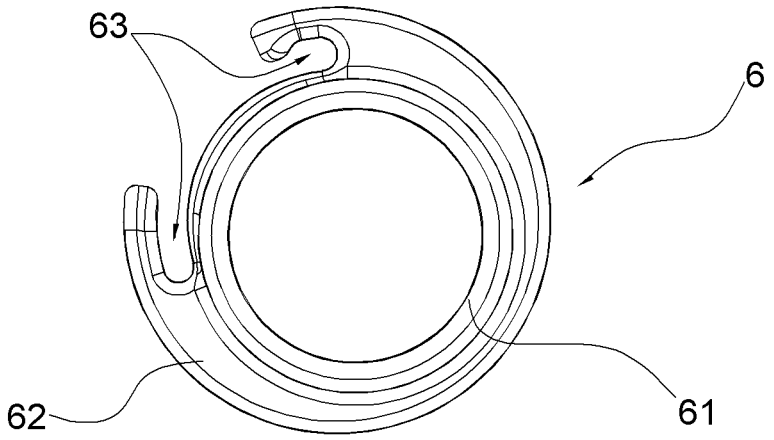
FIG. 20 is a front view of a retainer according to the Embodiment 3 of the present invention.
Figure 21:
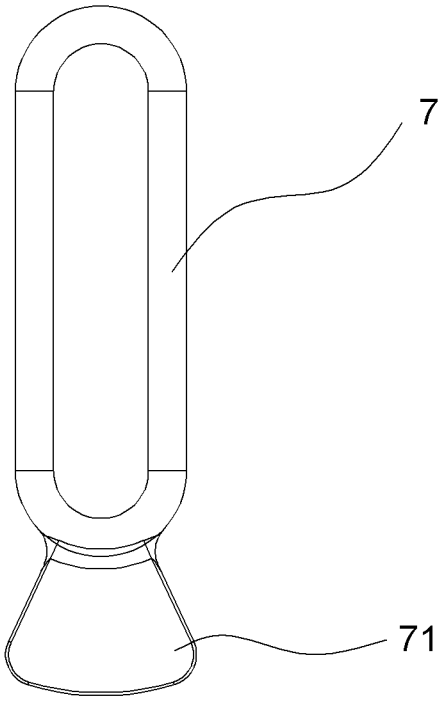
FIG. 21 is a front view of the binding ring with a grip, according to the Embodiment 3 of the present invention.

In this embodiment, the foldable pole further comprises a binding ring 7 having two ends and a retainer 6. The retainer 6 is disposed on the first pole section 11 or on the handle 2. Of course, the retainer 6 may be sheathed on the first pole section 11 at other positions, for example, may be connected to a locking collar 8, or the retainer 6 is disposed on the handle 2, and the retainer 6 divides the handle 2 into two parts for hand-holding, etc. The retainer 6 comprises an inner ring 61 and an outer ring 62 connected with each other. The inner ring 61 is disposed on the first pole section 11 or on the handle 2, and the outer ring 62 is C-shaped and has an opening forming two arc retaining grooves 63 at two ends thereof, as shown in FIG. 18. In this embodiment, the binding ring 7 is an elastic ring with a button, for example, a rubber ring, as shown in FIG. 21. The binding ring 7 has a grip 71 for holding with a hand. The binding ring 7 is an elastic ring, one end of which is retained in one of the retaining grooves 63, and the other end of which is retained in the other one of the retaining grooves 63. In this way, the pole body 1 can be fixed by the binding ring 7 and the retainer 6 after being folded, to avoid unfolding. To ensure adjustable height of the pole, usually, the first pole section is configured as a telescopic tube. An extension and retraction locking mechanism 10 is arranged between the upper tube and the lower tube of the telescopic tube to lock the tube after its height has been adjusted. Usually, the extension and retraction locking mechanism 10 has a locking collar 8. That is, the locking collar 8 is arranged at the joint of the extension and retraction locking mechanism 10. A concave positioning surface, which is resisted against the folded pole section for the purpose of positioning, is formed on the locking collar 8 at a position corresponding to the retained side of the retainer 6.

Figure 15:
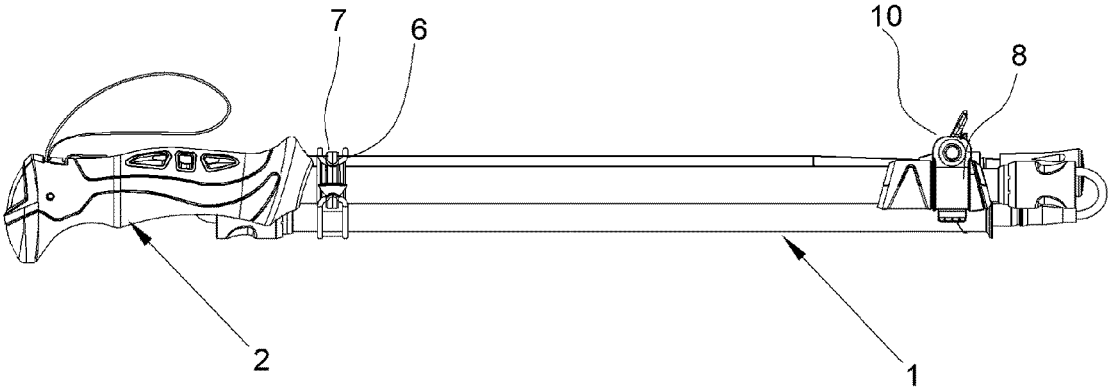
FIG. 15 is a perspective view of the foldable pole in a folded state according to the Embodiment 3 of the present invention.
Figure 16:
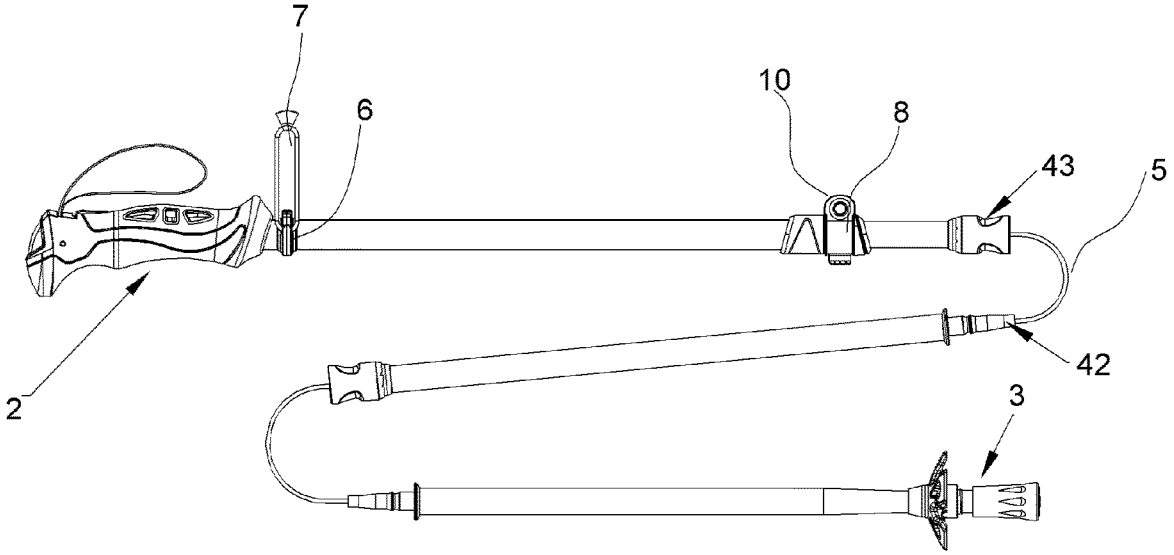
FIG. 16 is a perspective view of the foldable pole of FIG. 15, after a binding ring is released.
Figure 17:
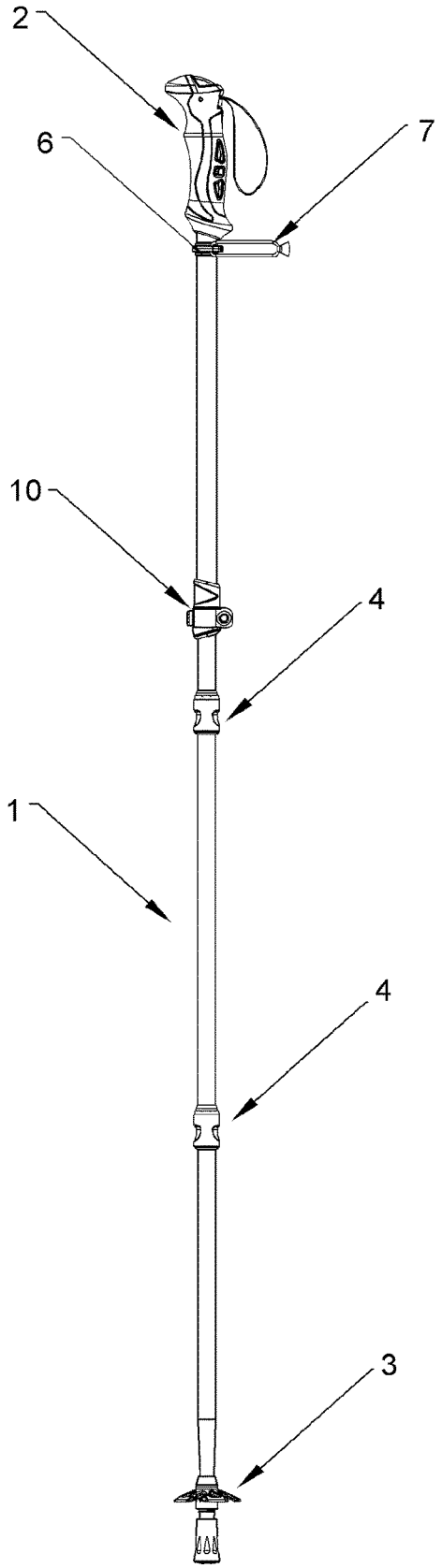
FIG. 17 is a perspective view of the foldable pole with the locking mechanism in a locked state according to the Embodiment 3 of the present invention.

When the pole is not used, first, the pole sections are folded, as shown in FIG. 15. The binding ring 7 is an elastic ring, one end of which is retained in one of the retaining grooves 63, and the other end of which is retained in the other one of the retaining grooves 63. In this way, the pole body 1 can be fixed by the binding ring 7 and the retainer 6 after being folded. It is convenient to carry and store. When the pole is to be used, one end of the binding ring 7 is separated from the retainer 6 simply by holding the grip 71 of the binding ring 7 with a hand, and then the pole body 1 can be separated from the retainer 6. Then, the pole body 1 is unfolded and positioned by the locking mechanism 4. Then, the pole can be used, as shown in FIG. 17.

Of course, the retainer 6 is integrally connected to the handle 2. They may be integrated by injection molding. The others are similar to those in the Embodiment 3.

Figure 22:
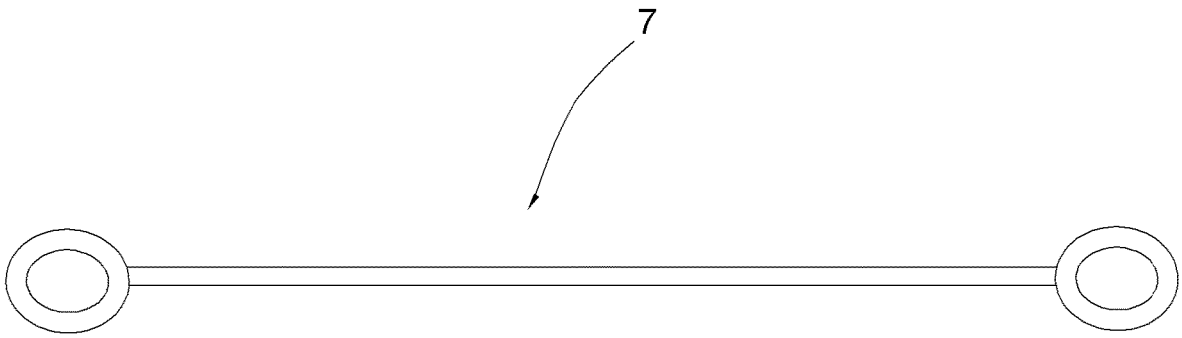
FIG. 22 is a front view of another binding ring according to the Embodiment 3 of the present invention.

As shown in FIG. 22, the binding ring 7 is an elastic ring with a button. The others are similar to those in the Embodiment 3.

Figure 23:
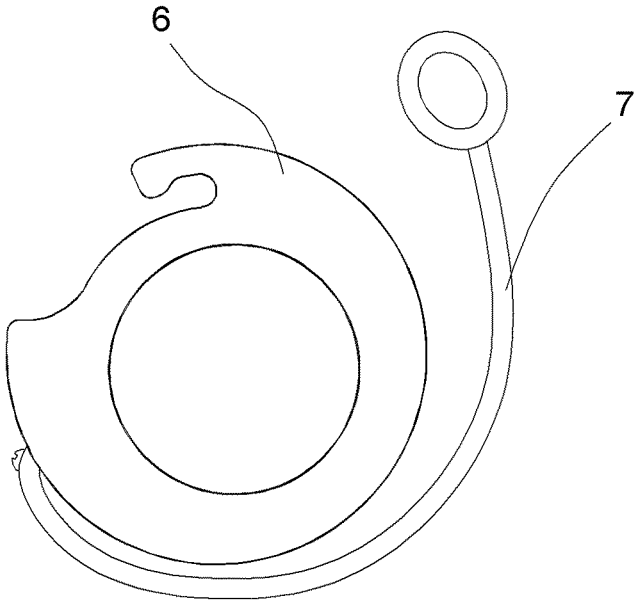
FIG. 23 is a front view of the retainer and the binding ring that one end of the binding ring is directly connected with the retainer, according to the Embodiment 3 of the present invention.

As shown in FIG. 23, one end of the binding ring 7 is directly fixedly connected to one end of the retainer 6, for example, directly integrated or fixed by screws. The binding ring 7 may be an elastic rope having a clasp at one ends. The others are similar to those in the Embodiment 3.

The best implementation of the locking mechanism for a foldable pole and the foldable pole has been disclosed in this embodiment. However, it should not be regarded as limiting the protection scope of the present invention. All replacements using equivalent or similar technical means to realize rotation shall fall into the protection scope of the present invention.

What is claimed is:

1. A locking mechanism for a foldable pole, the foldable pole comprising a pole body and an elastic drawstring disposed inside the pole body, the pole body being composed of a plurality of pole sections foldably connected with each other through the locking mechanism, and each of the pole sections having two ends;

the locking mechanism comprising:

a connector;

a connecting sleeve with a through hole for receiving the connector;

an elastic buckle disposed on the connecting sleeve for locking the connector; and a locking sleeve limitedly and movably up and down disposed out of the connecting sleeve;

wherein, the connecting sleeve is disposed on one end of adjacent two ends of two pole sections, and the connector is disposed on another end of the adjacent two ends of two pole sections;

the connector has a clamping groove corresponding to the elastic buckle;

one end of the elastic buckle passes through the connecting sleeve and is inserted into the clamping groove of the connector, so as to lock the connecting sleeve with the connector;

the locking sleeve is capable of pressing against the elastic buckle so as to lock or unlock the connecting sleeve with the connector.

2. The locking mechanism of claim 1, wherein the connecting sleeve has an upper portion and a lower portion;

the upper portion of the connecting sleeve is connected with a cylindrical connecting section, an end of an upper pole section has an opening for receiving the cylindrical connecting section;

the elastic buckle is a spring piece or an elastic piece with a substantially V-shaped or U-shaped cross section, and has a fixed end and an elastic locking end;

the connecting sleeve has a mounting base protruding from a peripheral surface of the lower portion of the connecting sleeve for receiving the fixed end of the elastic buckle, and a slot is formed in the mounting base for the elastic locking end of the elastic buckle to pass therethrough and to resist against the clamping groove of the connector, so that elastic buckle is locked with the connector inside the connecting sleeve under pressure of the locking sleeve; and the clamping groove is annular and is formed on a peripheral surface of the connector.

3. The locking mechanism of claim 2, wherein multiple of the elastic buckles are disposed on the peripheral surface of the connecting sleeve with a same interval; the connecting sleeve has multiple of the mounting bases disposed with a same interval.

4. The locking mechanism of claim 3, wherein two elastic buckles symmetrically disposed on the peripheral surface of the connecting sleeve; the connecting sleeve has two symmetrically disposed mounting bases.

5. The locking mechanism of claim 2, wherein the cylindrical connecting section is a lining tube joint connected with the end of the upper pole section;

a fixed sleeve is disposed on the lining tube joint, and an outer diameter of the fixed sleeve is greater than an outer diameter of the upper pole section;

the locking sleeve is disposed outside the connecting sleeve, the locking sleeve has a stepped inner hole with an upper portion and a lower portion, the upper portion of the stepped hole has a greater diameter than that of the lower portion of the stepped hole; and a compression spring is disposed between the fixed sleeve and a stepped inner wall of the stepped inner hole of the locking sleeve, so as to keep the locking sleeve to move downward to press the elastic buckle inward to lock the connector.

6. The locking mechanism of claim 5, wherein a guide groove fitted with the mounting bases is formed on an inner wall of a lower portion of the locking sleeve, the locking sleeve has an inclined slope formed on an inner surface of the guide groove for resisting against the elastic buckle; and when the locking sleeve is pushed upward, the inclined slope separates from elastic buckle, the locking sleeve releases the pressure to the elastic buckle, and the elastic locking end of the elastic buckle moves outward from the slot and apart from the connector, so as to unlock the connector.

7. The locking mechanism of claim 6, wherein the locking sleeve has two recesses (432) at two sides of an outer surface of the lower portion of the locking sleeve.

8. The locking mechanism of claim 5, wherein the locking sleeve has multiple elastic teeth formed on an inner wall of the lower portion of stepped inner hole, and the connecting sleeve has a limiting edge extending from a lower end of the connecting sleeve, which can block the elastic teeth so as to limit the locking sleeve on the connecting sleeve.

9. The locking mechanism of claim 1, wherein the connecting sleeve is disposed on an end of an upper pole section of the adjacent two pole sections, and the connector is disposed on an end of a lower pole section of the adjacent two pole sections;

the connecting sleeve has an upper portion, a middle portion and a lower portion;

the end of the upper pole section has an opening for receiving the upper portion of the connecting sleeve which is a cylindrical connecting section with a diameter matching with the opening of the end of the upper pole section and is connected with the upper pole section;

the lower portion of the connecting sleeve has a diameter greater than that of the upper portion of the connecting sleeve, and the middle portion of the connecting sleeve is a step for resisting against the end of the upper pole section;

the elastic buckle is a spring piece or an elastic piece with a substantially V-shaped or U-shaped cross section, and has a fixed end and an elastic locking end;

the connecting sleeve has a mounting base protruding from a peripheral surface of the lower portion of the connecting sleeve for receiving the fixed end of the elastic buckle, and a slot is formed in the mounting base for the elastic locking end of the elastic buckle to pass therethrough and to resist against the clamping groove of the connector, so that elastic buckle is locked with the connector inside the connecting sleeve under pressure of the locking sleeve; and the clamping groove is annular and is formed on a peripheral surface of the connector.

10. The locking mechanism of claim 9, wherein a fixed sleeve is disposed on the upper pole section corresponding to the upper portion of the connecting sleeve, and an outer diameter of the fixed sleeve is greater than that of the mounting base of the connecting sleeve;

the locking sleeve is disposed outside the fixed sleeve and the connecting sleeve, the locking sleeve has a stepped inner hole with an upper portion matching with the fixed sleeve and a lower portion matching with the mounting base, the upper portion of the stepped hole has a greater diameter than that of the lower portion of the stepped hole;

an inner wall of the lower portion of the stepped inner hole is resisted against the elastic buckle; and a compression spring is disposed between the fixed sleeve and a stepped inner wall of the stepped inner hole of the locking sleeve, so as to keep the locking sleeve to move downward to press the elastic buckle inward to lock the connector.

11. The locking mechanism of claim 10, wherein a guide groove fitted with the mounting bases is formed on an inner wall of a lower portion of the locking sleeve, the locking sleeve has an inclined slope formed on an inner surface of the guide groove for resisting against the elastic buckle; and when the locking sleeve is pushed upward, the inclined slope separates from elastic buckle, the locking sleeve releases the pressure to the elastic buckle, and the elastic locking end of the elastic buckle moves outward from the slot and apart from the connector, so as to unlock the connector.

12. The locking mechanism of claim 10, wherein the locking sleeve has multiple elastic teeth formed on an inner wall of the lower portion of stepped inner hole, and the connecting sleeve has a limiting edge extending from a lower end of the connecting sleeve, which can block the elastic teeth so as to limit the locking sleeve on the connecting sleeve.

13. The locking mechanism of claim 9, wherein multiple of the elastic buckles are disposed on the peripheral surface of the connecting sleeve with a same interval; the connecting sleeve has multiple of the mounting bases disposed with a same interval.

14. The locking mechanism of claim 1, wherein the connector comprises a fixed socket and a plug; the fixed socket is inserted into an upper opening of a lower pole section by dimensional fit;

an upper end of the fixed socket has an annular flange resisted against an outer side of the upper opening of the lower pole section; the plug is divided into three sections including a cylindrical upper section, a cylindrical lower section with an increased diameter, and a middle transition section with a truncated-cone shape; and the lower section of the plug is fixed in the fixed socket; and the clamping groove is annularly formed in the lower section of the plug.

15. The locking mechanism of claim 14, wherein a diameter of the annular flange is greater than an inner diameter of the locking sleeve;

after the connecting sleeve is fixedly inserted in the connector, the locking sleeve is resisted against the annular flange;

a positioning convex ring is formed on an inner wall of the fixed socket at a position corresponding to the annular flange;

a corresponding annular positioning groove is formed on an outer wall of the plug; the lower section of the plug is inserted and fixed in the fixed socket to be fitted with the positioning convex ring through the annular positioning groove; and a lower end of the plug is basically flush with a lower end of the fixed socket.

16. The locking mechanism of claim 15, wherein an inner sleeve is fixedly surrounded on an inner wall of an upper portion of the connecting sleeve, and the inner sleeve has truncated-cone holes matching with the upper section and the middle section of the plug.

17. The locking mechanism of claim 1, wherein the connector is hollow; one end of the elastic drawstring is fixed inside an uppermost pole section of the pole body, the other end of the elastic drawstring passes through each of the pole sections of the pole body, each connecting sleeve and the connector, to be connected with the connector on a lowermost pole section.

18. A foldable pole, comprising a handle, a pole body, a support leg, and a plurality of the locking mechanisms of claim 1 disposed on the pole body;

wherein the pole body is composed of a plurality of pole sections foldably connected with each other through the locking mechanisms.

19. The foldable pole of claim 18, further comprising a binding ring having two ends, and a retainer;

wherein one end of the binding ring is connected with one side of the retainer, and the other end of the binding ring surrounds the folded pole sections and rings on the retainer to bind the folded pole sections.

20. The foldable pole of claim 19, wherein the retainer is disposed on an uppermost pole section or on the handle.

21. The foldable pole of claim 20, wherein the retainer comprises an inner ring and an outer ring connected with each other, the inner ring is fixedly disposed on the uppermost pole section or on the handle, and the outer ring is C-shaped and has an opening forming two arc retaining grooves at two ends thereof.

22. The foldable pole of claim 21, wherein the binding ring is an elastic ring, one end of which is retained in one of the retaining grooves, and the other end of which is retained in the other one of the retaining grooves.

23. The foldable pole of claim 22, wherein the retainer is disposed on the handle, and the retainer divides the handle into two parts for hand-holding.

24. The foldable pole of claim 19, wherein the retainer is integrally connected to the handle.

25. The foldable pole of claim 19, wherein the binding ring is an elastic ring with a button.

26. The foldable pole of claim 25, wherein the binding ring has a grip for holding with a hand.

* * * * *